US007682001B2

(12) United States Patent
Lee et al.

(10) Patent No.: US 7,682,001 B2
(45) Date of Patent: Mar. 23, 2010

(54) PIEZOELECTRIC ACTUATOR INKJET HEAD AND METHOD OF FORMING THE SAME

(75) Inventors: Tae-kyung Lee, Suwon-si (KR); Jae-woo Chung, Yongin-si (KR); Kyo-yeol Lee, Yongin-si (KR); Hwa-sun Lee, Suwon-si (KR); Seung-mo Lim, Suwon-si (KR); Jae-chang Lee, Hwaseong-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 586 days.

(21) Appl. No.: 11/581,333

(22) Filed: Oct. 17, 2006

(65) Prior Publication Data

US 2007/0195134 A1 Aug. 23, 2007

(30) Foreign Application Priority Data

Feb. 20, 2006 (KR) ..... 10-2006-0016229

(51) Int. Cl.
*B41J 2/045* (2006.01)

(52) U.S. Cl. ..... 347/72

(58) Field of Classification Search ..... 347/68, 347/70–72

See application file for complete search history.

(56) References Cited

U.S. PATENT DOCUMENTS 6,378,996 B1 * 4/2002 Shimada et al. ..... 347/70
6,701,593 B2 * 3/2004 Lin et al. ..... 29/25.35
7,175,262 B2 * 2/2007 Furuhata ..... 347/68
7,358,643 B2 * 4/2008 Sugahara ..... 310/311

* cited by examiner

*Primary Examiner*—An H Do
(74) *Attorney, Agent, or Firm*—Stanzione & Kim LLP

(57) ABSTRACT

A piezoelectric actuator of an inkjet head and a method of forming the piezoelectric actuator. The piezoelectric actuator is formed on a vibration plate to provide a driving force to each of a plurality of pressure chambers. The piezoelectric actuator includes a lower electrode formed on the vibration plate, a piezoelectric layer formed on the lower electrode at a position corresponding to each of the pressure chambers, a supporting pad formed on the lower electrode, the supporting pad contacting one end of the piezoelectric layer and extending away from the one end of the piezoelectric layer, and an upper electrode extending from a top surface of the piezoelectric layer to a top surface of the supporting pad. The upper electrode is bonded to a driving circuit above the supporting pad to receive a voltage from the driving circuit. The piezoelectric layer may have substantially the same length as the pressure chamber. The supporting pad may be formed of a photosensitive polymer and may have substantially the same height as the piezoelectric layer. The upper electrode may include a first portion formed on the piezoelectric layer and a second portion formed on the supporting pad, and the second portion may be wider than the first portion.

20 Claims, 7 Drawing Sheets

PIEZOELECTRIC ACTUATOR INKJET HEAD AND METHOD OF FORMING THE SAME

CROSS-REFERENCE TO RELATED APPLICATIONS

This application claims the benefit of Korean Patent Application No. 10-2006-0016229, filed on Feb. 20, 2006, in the Korean Intellectual Property Office, the disclosure of which is incorporated herein in its entirety by reference.

BACKGROUND OF THE INVENTION

1. Field of the Invention

The present general inventive concept relates to a piezoelectric inkjet head, and more particularly, to a piezoelectric actuator of an inkjet head that has an improved structure such that a flexible printed circuit can be bonded to the piezoelectric actuator more reliably, and a method of forming the piezoelectric actuator of the inkjet head.

2. Description of the Related Art

Generally, inkjet heads are devices for printing a color image on a printing medium by ejecting ink droplets onto a desired region of the printing medium.

Depending on an ink ejecting method used by the inkjet heads, the inkjet heads can be classified as thermal inkjet heads and piezoelectric inkjet heads. The thermal inkjet head generates bubbles in the ink to be ejected using heat and ejects the ink by utilizing the expansion of the bubbles. On the other hand, the piezoelectric inkjet head ejects ink using pressure generated by deforming a piezoelectric material.

FIG. 1A is a partial plan view illustrating a conventional piezoelectric inkjet head, and FIG. 1B is a sectional view taken from line A-A' of the conventional piezoelectric inkjet head of FIG. 1A.

Referring to FIGS. 1A and 1B, a manifold 11, a plurality of restrictors 12, and a plurality of pressure chambers 13 forming an ink flow channel are formed in a flow channel plate 10 of the inkjet head. A vibration plate 20 which can be deformed by piezoelectric actuators 40 is bonded to a top surface of the flow channel plate 10, and a nozzle plate 30 in which a plurality of nozzles 31 are formed is bonded to a bottom surface of the flow channel plate 10. The vibration plate 20 can be formed integrally with the flow channel plate 10, and the nozzle plate 30 can also be formed integrally with the flow channel plate 10.

The manifold 11 is an ink passage supplying ink from an ink reservoir (not illustrated) to the respective pressure chambers 13, and the restrictors 12 are ink passages allowing inflow of ink from the manifold 11 to the pressure chambers 13. The pressure chambers 13 are filled with the supplied ink and are arranged at one side or both sides of the manifold 11. The nozzles 31 are formed through the nozzle plate 30 and connected to the respective pressure chambers 13. The vibration plate 20 is bonded to the top surface of the flow channel plate 10 to cover the pressure chambers 13. The vibration plate 20 is deformed by an operation of the piezoelectric actuators 40 to change pressures in the respective pressure chambers 13 so as to eject ink from the ink chambers 13. Each of the piezoelectric actuators 40 includes a lower electrode 41, a piezoelectric layer 42, and an upper electrode 43 that are sequentially stacked on the vibration plate 20. The lower electrode 41 is formed along the entire surface of the vibration plate 20 as a common electrode. The piezoelectric layer 42 is formed on the lower electrode 41 above each of the pressure chambers 13. The upper electrode 43 is formed on the piezoelectric layer 42 as a driving electrode for applying a voltage to the piezoelectric layer 42.

To apply a driving voltage to the piezoelectric actuator 40, a flexible printed circuit (FPC) 50 is connected to the upper electrode 43. In particular, the FPC 50 is placed on the piezoelectric actuators 40 with signal lines 51 of the FPC 50 in alignment with the upper electrodes 43 of the piezoelectric actuators 40, and then the signal lines 51 are bonded to top surfaces of the upper electrodes 43 by heating and pressing.

However, as illustrated in FIG. 1A, since the pressure chambers 13 are narrow and long, the piezoelectric layers 42 and the upper electrodes 43 are also narrow and long. Therefore, bonding regions between the upper electrodes 43 and the signal lines 51 must be sufficiently long for reliable bonding. For this reason, in the conventional inkjet head, the piezoelectric layers 42 and the upper electrodes 43 are substantially longer than the pressure chambers 13 (for example, two times longer than the pressure chambers 13), and the signal lines 51 of the FPC 50 are bonded to portions of the upper electrodes 43 that are not situated above the pressure chambers 13.

Although the piezoelectric layers 42 are not required to be longer than the pressure chambers 13 for changing the pressures of the pressure chambers 13, the piezoelectric layers 42 are formed to be much longer than the pressure chambers 13 for insulating the upper electrodes 43 from the lower electrode 41 and for supporting the upper electrodes 43. In this case, the capacitance, driving load, and response time of the piezoelectric actuators 40 are increased.

Further, since the piezoelectric layers 42 are long and narrow as described above, the upper electrodes 43 formed on the piezoelectric layers 42 should also be long and narrow. Therefore, when the FPC 50 and the upper electrodes 43 are slightly misaligned, the signal lines 51 of the FPC 50 will not be precisely bonded to the top surfaces of the upper electrodes 43, thereby causing bonding failure or decreasing bonding strength. If a bonding strength between the signal lines 51 of the FPC 50 and the upper electrodes 43 is weak, the inkjet head cannot be reliably used for a long time.

SUMMARY OF THE INVENTION

The present general inventive concept provides a piezoelectric actuator of an inkjet head that has an improved structure such that a length and response time of a piezoelectric layer can be reduced and a flexible printed circuit (FPC) can be bonded to the piezoelectric actuator more firmly and stably.

Additional aspects of the present general inventive concept will be set forth in part in the description which follows and, in part, will be obvious from the description, or may be learned by practice of the general inventive concept.

The foregoing and/or other aspects of the present general inventive concept may be achieved by providing a piezoelectric actuator of an inkjet head, the piezoelectric actuator being formed on a vibration plate to provide a driving force to each of a plurality of pressure chambers, the piezoelectric actuator including a lower electrode formed on the vibration plate, a piezoelectric layer formed on the lower electrode at a position corresponding to each of the pressure chambers, a supporting pad formed on the lower electrode, the supporting pad contacting one end of the piezoelectric layer and extending away from the one end of the piezoelectric layer, and an upper electrode extending from a top surface of the piezoelectric layer to a top surface of the supporting pad. The upper electrode is bonded to a driving circuit above the supporting pad to receive a voltage from the driving circuit.

An insulation layer may be formed between the vibration plate and the lower electrode.

The piezoelectric layer may have substantially the same length as the pressure chamber.

The supporting pad may have substantially the same height as the piezoelectric layer. The supporting pad may be formed of an insulating material such as a photosensitive polymer.

The upper electrode may include a first portion formed on the piezoelectric layer and a second portion formed on the supporting pad, and the second portion may be wider than the first portion.

The driving circuit may be a flexible printed circuit (FPC) having a signal line bonded to the upper electrode.

The foregoing and/or other aspects of the present general inventive concept may also be achieved by providing a method of forming a piezoelectric actuator of an inkjet head, the piezoelectric actuator being formed on a vibration plate to provide a driving force to each of a plurality of pressure chambers, the method including forming a lower electrode on the vibration plate, forming a piezoelectric layer on the lower electrode at a position corresponding to each of the pressure chambers, forming a supporting pad on the lower electrode, the supporting pad contacting one end of the piezoelectric layer and extending away from the one end of the piezoelectric layer, forming an upper electrode that extends from a top surface of the piezoelectric layer to a top surface of the supporting pad, and bonding a driving circuit to the upper electrode above the supporting pad to apply a voltage to the upper electrode.

The forming of the lower electrode may include forming an insulation layer on the vibration plate, and forming the lower electrode on the insulation layer.

The piezoelectric layer may have substantially the same length as the pressure chamber. The forming of the piezoelectric layer may include coating a top surface of the lower electrode with a piezoelectric material paste by screen printing, and drying and sintering the piezoelectric material paste.

The supporting pad may have substantially the same height as the piezoelectric layer. The forming of the supporting pad may include coating the lower electrode and the piezoelectric layer with a photosensitive polymer, and patterning the photosensitive polymer. The forming of the supporting pad may further include adjusting the top surfaces of the piezoelectric layer and the supporting pad to the same height by chemical mechanical polishing (CMP).

The forming of the upper electrode may include forming the upper electrode to include a first portion disposed on the piezoelectric layer and a second portion disposed on the supporting pad, and the second portion may be wider than the first portion.

The forming of the upper electrode may include forming the upper electrode by screen printing an electrode material paste on the top surfaces of the piezoelectric layer and the supporting pad, or forming the upper electrode by depositing a conductive metal on the top surfaces of the piezoelectric layer and the supporting pad to a predetermined thickness using one of sputtering, an evaporator, and an e-beam.

The foregoing and/or other aspects of the present general inventive concept may also be achieved by providing a piezoelectric actuator of an inkjet head, the piezoelectric actuator including a vibration plate, a lower electrode formed on the vibration plate, a piezoelectric layer formed on the lower electrode, and an upper electrode having a first portion disposed on the piezoelectric layer and a second portion extended from the first portion in a first direction, the first portion having a first width in a second direction perpendicular to the first direction, and the second portion having a second width wider than the first width in the second direction.

The foregoing and/or other aspects of the present general inventive concept may also be achieved by providing an inkjet head usable in an image forming apparatus, including an ink flow structure having a flow channel plate and a nozzle plate disposed on a first side of the flow channel plate to form a pressure chamber, and a piezoelectric actuator having a vibration plate disposed on a second side of the flow channel plate, a lower electrode formed on the vibration plate, a piezoelectric layer formed on the lower electrode at a position corresponding to the pressure chamber, a supporting pad formed on the lower electrode and contacting one end of the piezoelectric layer to be extended away from the one end of the piezoelectric layer, and an upper electrode extending from a top surface of the piezoelectric layer to a top surface of the supporting pad, wherein the upper electrode is bonded to a driving circuit above the supporting pad to receive a voltage from the driving circuit.

The foregoing and/or other aspects of the present general inventive concept may also be achieved by providing an inkjet head usable in an image forming apparatus, including an ink flow structure having a flow channel plate and a nozzle plate disposed on a first side of the flow channel plate to form a pressure chamber, and a piezoelectric actuator having a vibration plate disposed on a second side of the flow channel plate, a lower electrode formed on the vibration plate, a piezoelectric layer formed on the lower electrode, and an upper electrode having a first portion disposed on the piezoelectric layer and a second portion extended from the first portion in a first direction to be connected to a signal line, the first portion having a first width in a second direction perpendicular to the first direction, and the second portion having a second width wider than the first width in the second direction.

The foregoing and/or other aspects of the present general inventive concept may also be achieved by providing a method of fabricating a piezoelectric actuator usable in an inkjet head, the method including forming a lower electrode formed on a vibration plate, and forming a piezoelectric layer on the lower electrode; and forming an upper electrode having a first portion disposed on the piezoelectric layer and a second portion extended from the first portion in a first direction, the first portion having a first width in a second direction perpendicular to the first direction, and the second portion having a second width wider than the first width in the second direction.

The foregoing and/or other aspects of the present general inventive concept may also be achieved by providing a method of fabricating an inkjet head usable in an image forming apparatus, the method including forming an ink flow structure having a flow channel plate and a nozzle plate disposed on a first side of the flow channel plate to form a pressure chamber, and forming a piezoelectric actuator having a vibration plate disposed on a second side of the flow channel plate, a lower electrode formed on the vibration plate, a piezoelectric layer formed on the lower electrode at a position corresponding to the pressure chamber, a supporting pad formed on the lower electrode and contacting one end of the piezoelectric layer to be extended away from the one end of the piezoelectric layer, and an upper electrode extending from a top surface of the piezoelectric layer to a top surface of the supporting pad, wherein the upper electrode is bonded to a driving circuit above the supporting pad to receive a voltage from the driving circuit.

The foregoing and/or other aspects of the present general inventive concept may also be achieved by providing a method of fabricating an inkjet head usable in an image forming apparatus, the method including forming an ink flow structure having a flow channel plate and a nozzle plate disposed on a first side of the flow channel plate to form a pressure chamber, and forming a piezoelectric actuator having a vibration plate disposed on a second side of the flow channel plate, a lower electrode formed on the vibration plate, a piezoelectric layer formed on the lower electrode, and an upper electrode having a first portion disposed on the piezoelectric layer and a second portion extended from the first portion in a first direction to be connected to a signal line, the first portion having a first width in a second direction perpendicular to the first direction, and the second portion having a second width wider than the first width in the second direction.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
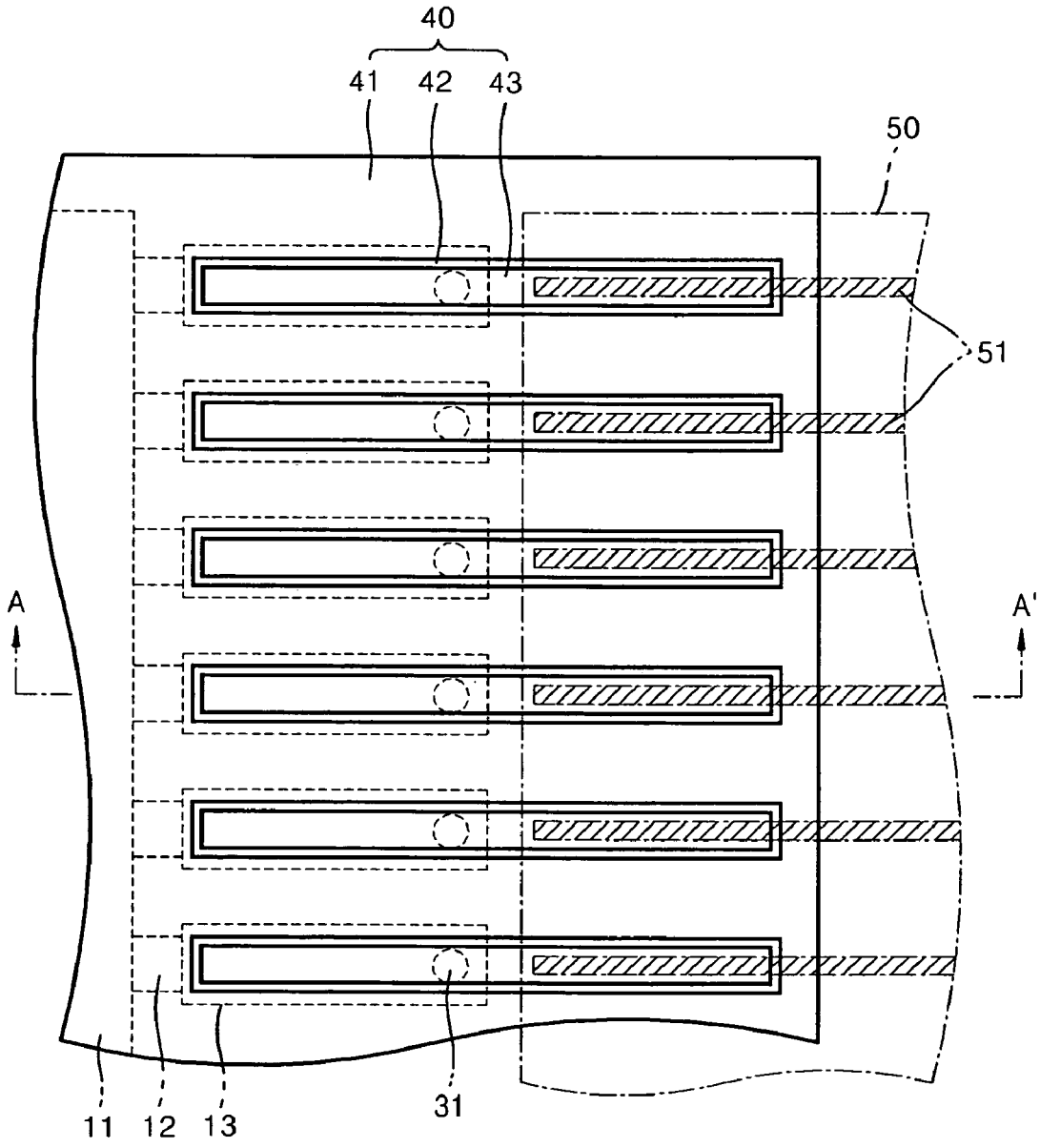
FIG. 1A (PRIOR ART)
FIG. 1A is a partial plan view illustrating a conventional piezoelectric inkjet head.
Figure 1B:
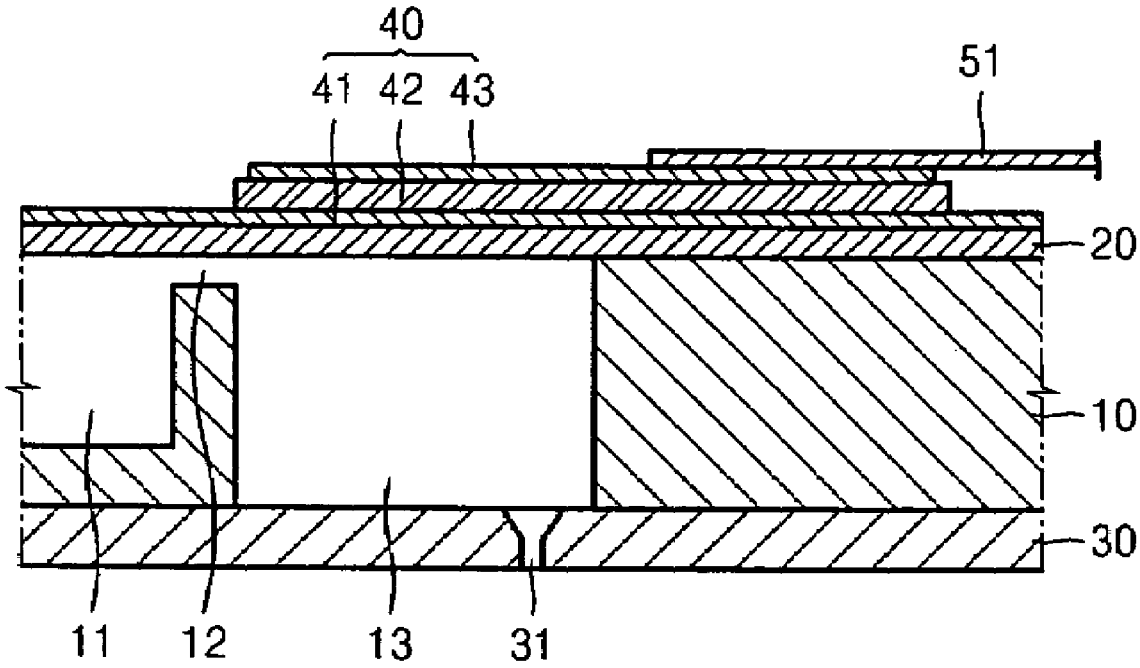
FIG. 1B (PRIOR ART)
FIG. 1B is a sectional view taken from line A-A' of the conventional piezoelectric inkjet head of FIG. 1A.

The present general inventive concept will now be described more fully with reference to the accompanying drawings, in which exemplary embodiments of the general inventive concept are illustrated. In the drawings, like reference numerals refer to like elements, and the thicknesses of layers and regions are exaggerated for clarity. It will also be understood that when a layer is referred to as being "on" another layer or substrate, it can be directly on the other layer or substrate, or intervening layers may also be present.

Figure 2A:
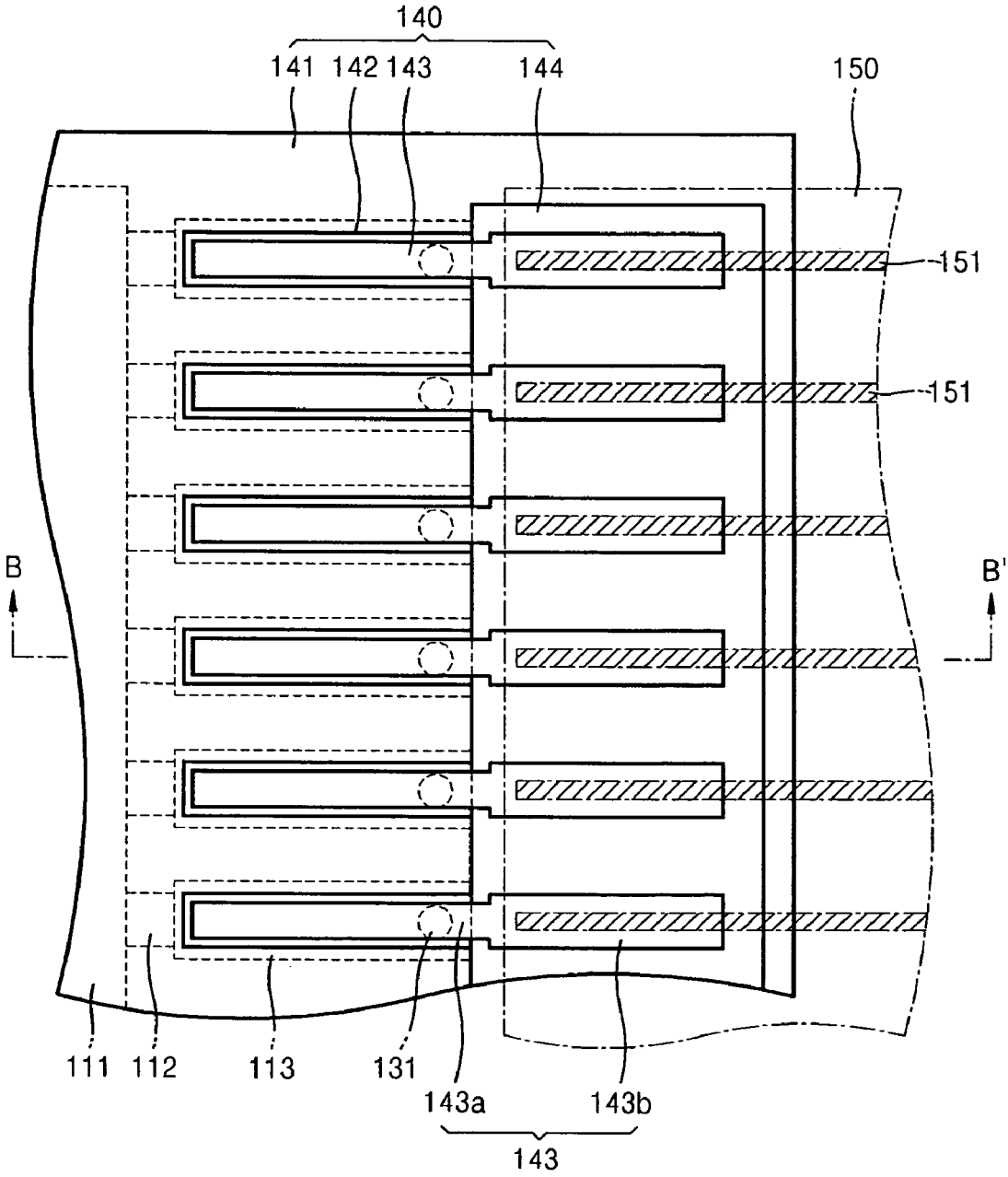
FIG. 2A is a partial plan view illustrating a piezoelectric inkjet head with piezoelectric actuators, according to an embodiment of the present general inventive concept.
Figure 2B:
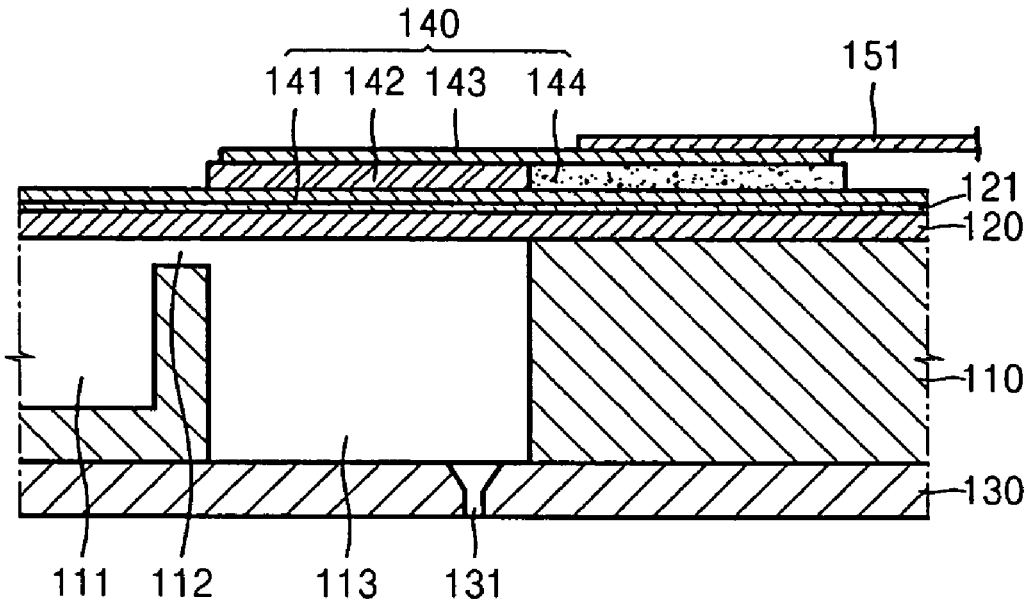
FIG. 2B is a sectional view taken from line B-B' of the piezoelectric inkjet head of FIG. 2A.

FIG. 2A is a partial plan view illustrating a piezoelectric inkjet head with piezoelectric actuators according to an embodiment of the present general inventive concept, and FIG. 2B is a sectional view taken from line B-B' of the piezoelectric inkjet head of FIG. 2A. The inkjet head may be used in an image forming apparatus.

Referring to FIGS. 2A and 2B, the piezoelectric inkjet head includes a plurality of plates forming an ink flow channel. The plurality of plates may be three in number, including a flow channel plate 110, a vibration plate 120 (i.e., deformable layer), and a nozzle plate 130. A manifold 111, a plurality of restrictors 112, and a plurality of pressure chambers 113 are formed in the flow channel plate 110. The vibration plate 120 is bonded to a top surface of the flow channel plate 110 to cover the pressure chambers 113. The nozzle plate 130 is bonded to a bottom surface of the flow channel plate 110. A plurality of nozzles 131 is formed through the nozzle plate 130. Although the vibration plate 120 and the nozzle plate 130 are described as being bonded to the top and bottom surfaces of the flow channel plate 110, this description of the orientation is not intended to limit the scope of the present general inventive concept and is provided for illustration purposes.

The structure of the ink flow channel illustrated in FIGS. 2A and 2B is exemplary. That is, the ink flow channel of the piezoelectric inkjet head can be formed using various structures having various numbers of plates and need not necessarily use the three plates 110, 120, and 130 illustrated in FIG. 2B. For example, the vibration plate 120 can be formed integrally with the flow channel plate 110, and/or the nozzle plate 130 can be formed integrally with the flow channel plate 110.

Piezoelectric actuators 140 are formed on the vibration plate 120 to provide ink ejecting forces to the respective pressure chambers 113 by deforming the vibration plate 120.

Each of the piezoelectric actuators 140 includes a lower electrode 141 as a common electrode, a piezoelectric layer 142 deformable in response to a voltage applied thereto, and an upper electrode 143 as a driving electrode. The lower electrode 141, the piezoelectric layer 142, and the upper electrode 143 are sequentially formed on the vibration plate 120. Particularly, the piezoelectric actuator 140 further includes a supporting pad 144 to support a portion of the upper electrode 143. A driving circuit such as an FPC 150 is bonded to the upper electrode 143 above the supporting pad 144 in order to apply a voltage to the upper electrode 143.

In particular, the lower electrode 141 of the piezoelectric actuator 140 is formed on the vibration plate 120. The lower electrode 141 is formed of a conductive metal. A single metal layer can be formed as the lower electrode 141, or two metal layers such as Ti layer and Pt layer can be formed as the lower electrode 141. Additionally, an insulating layer 121 may be formed on a top surface of the vibration plate 120, and then the lower electrode 141 may be formed on a top surface of the insulation layer 121 to provide insulation between the vibration plate 120 and the lower electrode 141.

The piezoelectric layer 142 is formed on the lower electrode 141 at a region corresponding to each of the pressure chambers 113. A shape of the piezoelectric layer 142 corresponds to that of the pressure chamber 113. Specifically, a length of the piezoelectric layer 142 can be substantially equal to or slightly larger than that of the pressure chamber 113. The piezoelectric layer 142 is formed of a piezoelectric material. The piezoelectric layer 142 may be formed of a ceramic material such as lead zirconate titanate (PZT).

As mentioned above, the piezoelectric layer 142 of the piezoelectric actuator 140 is shorter than the conventional piezoelectric layer such that a capacitance, an electric load, and a response time of the piezoelectric layer 142 can be reduced and a durability of the piezoelectric layer 142 can be improved.

The supporting pad 144 is formed on the lower electrode 141. The supporting pad 144 contacts an end of the piezoelectric layer 142 and extends away from the end of the piezoelectric layer 142 in a first direction. Although the supporting pad 144 can have a shape corresponding to each of the piezoelectric layers 142, the supporting pad 144 has an elongated shape along the plurality of piezoelectric layers 142 as illustrated in FIG. 2A.

The supporting pad 144 may have substantially the same height as the piezoelectric layer 142. In this case, the upper electrode 143 can be easily formed on the piezoelectric layer 142 and the supporting pad 144. The supporting pad 144 is formed of an insulating material to provide insulation between the lower electrode 141 and the upper electrode 143. For example, the supporting pad 144 may be formed of a photosensitive polymer such as a photoresist.

The upper electrode 143 extends from the top surface of the piezoelectric layer 142 to the top surface of the supporting pad 144. The upper electrode 143 has a first portion 143*a* formed on the piezoelectric layer 142 and a second portion 143*b* formed on the supporting pad 144. The second portion 143*b* is extended from the first portion 143*a* in the first direction. Since the supporting pad 144 is wide in a second direction perpendicular to the first direction, the upper electrode 143 can be formed such that the second portion 143*b* is wider than the first portion 143*a* in the second direction. That is, since the supporting pad 144 is wider than the piezoelectric layer 142 or the first portion 143*a* in the second direction, the second portion 143*b* can be formed to be wider than the first portion 143*a* or the nozzle 131 in the second direction.

The FPC 150 having signal lines 151 (i.e., the driving circuit) is bonded to the upper electrode 143 to apply a voltage to the piezoelectric actuator 140. Specifically, the signal lines 151 of the FPC 150 are bonded to top surfaces of the second portions 143*b* of the upper electrodes 143, respectively. The signal lines 151 may be disposed in the second direction to connect the second portion 143*b* of the upper electrode 143 to a voltage source of the FPC 150. Here, since the second portions 143*b* of the upper electrodes 143 are wide, contact surfaces between the signal lines 151 and the second portions 143*b* are relatively wide so that a bonding strength between the signal lines 151 and the second portions 143*b* can be increased. Further, even when the signal lines 151 of the FPC 150 are not precisely aligned with the second portions 143*b* of the upper electrodes 143, the signal lines 151 can be bonded to the second portions 143*b* since the second portions 143*b* are wide, thereby reducing a possibility of bonding failure.

A first ratio between widths of the first portion 143*a* and the second portion 143*b* in the second direction may be greater than 1:1, for example, the first ration may be 1.5:1. A second ratio between widths of the second portion 143*b* and the signal line 151 in the second direction may be greater than about 1:1, for example, 1.5:1, 2:1 or 3:1.

A method of forming a piezoelectric actuator of an inkjet head according to an embodiment of the present general inventive concept will now be described.

FIGS. 3A through 3F are sectional views illustrating a method of forming the piezoelectric actuator 140 illustrated in FIGS. 2A and 2B according to an embodiment of the present general inventive concept.

Figure 3A:
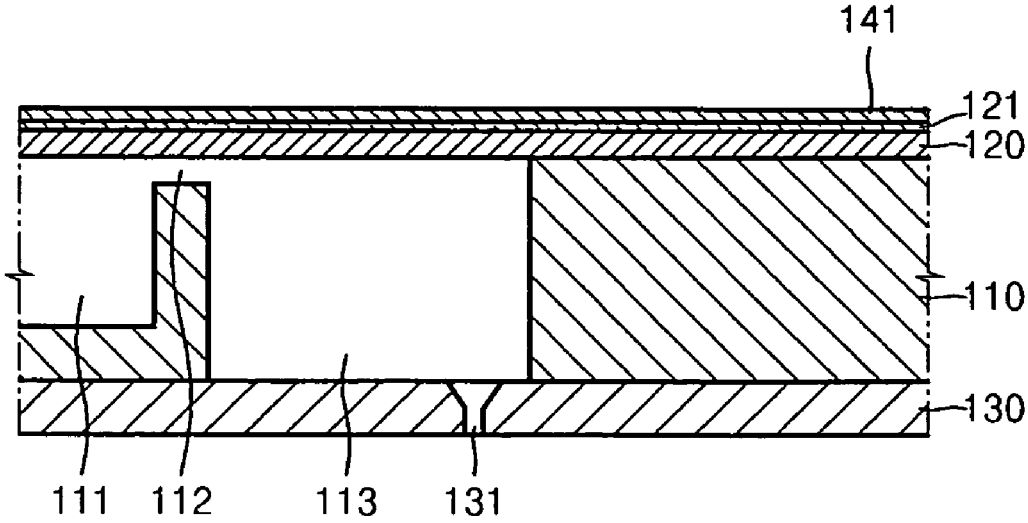
FIGS. 3A through 3F are sectional views illustrating a method of forming the piezoelectric actuator of FIGS. 2A and 2B, according to an embodiment of the present general inventive concept.

Referring to FIG. 3A, a lower electrode 141 is formed as a common electrode on a vibration plate 120. Before the lower electrode 141 is formed on the vibration plate 120, an insulation layer 121 can be formed on an entire surface of the vibration plate 120 to provide insulation between the vibration plate 120 and the lower electrode 141. In this case, the lower electrode 141 may be formed on an entire surface of the insulation layer 121. In the case in which the vibration plate 120 is formed of a silicon substrate, the insulation layer 121 can be formed of a silicon oxide. The lower electrode 141 can be formed by depositing a conductive metal on the entire surface of the vibration plate 120 or the insulation layer 121 to a predetermined thickness. The lower electrode 141 can be formed into a single metal layer or two metal layers such as Ti layer and Pt layer. In the latter case, the Ti layer can be formed to a thickness of about 400 Å by sputtering, and the Pt layer can be formed to a thickness of about 5,000 Å by sputtering.

Figure 3B:
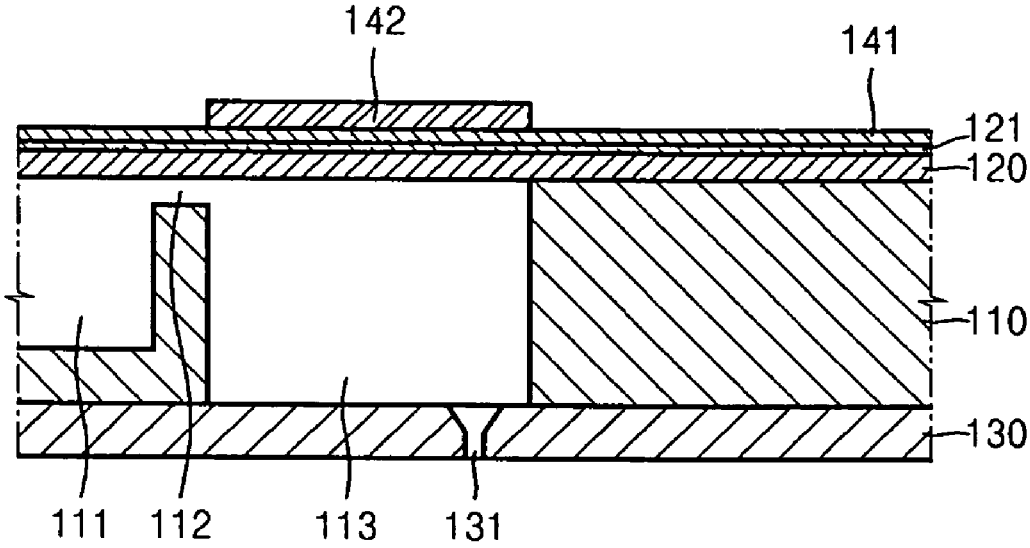

Referring to FIG. 3B, a piezoelectric layer 142 is formed on the lower electrode 141 above each of pressure chambers 113. Here, the piezoelectric layer 142 is formed to have a shape that corresponds to the pressure chamber 113. The length of the piezoelectric layer 142 may be substantially equal to or slightly larger than that of the pressure chamber 113. The piezoelectric layer 142 may be formed by screen printing a piezoelectric material paste such as PZT ceramic paste on the lower electrode 141 to a predetermined thickness, drying the printed paste, and sintering the dried paste at a temperature range of about 900° C. to 1200° C.

Figure 3C:
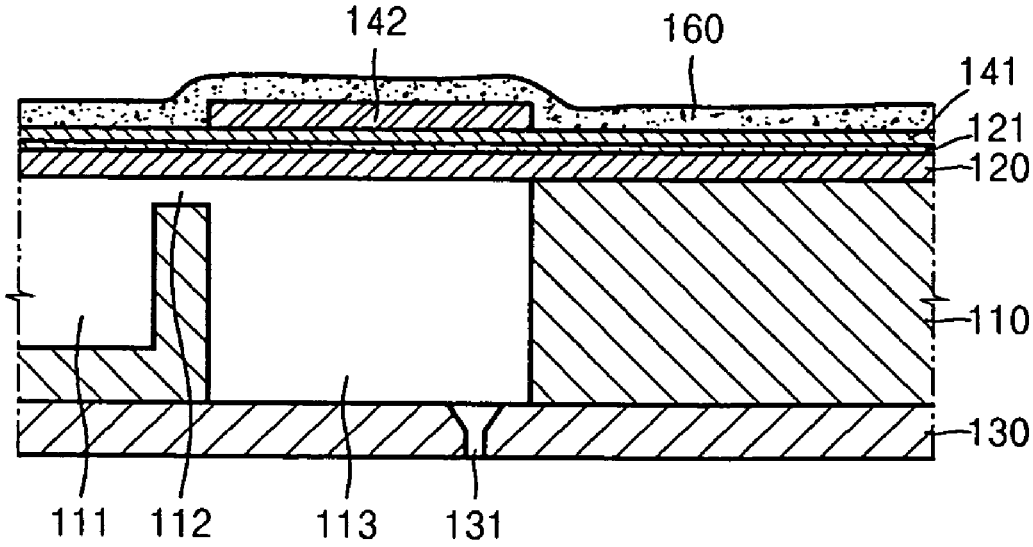

Referring to FIG. 3C, a photosensitive polymer such as a photoresist 160 is formed on the lower electrode 141 and the piezoelectric layer 142. The photoresist 160 may be formed by spin coating.

Figure 3D:
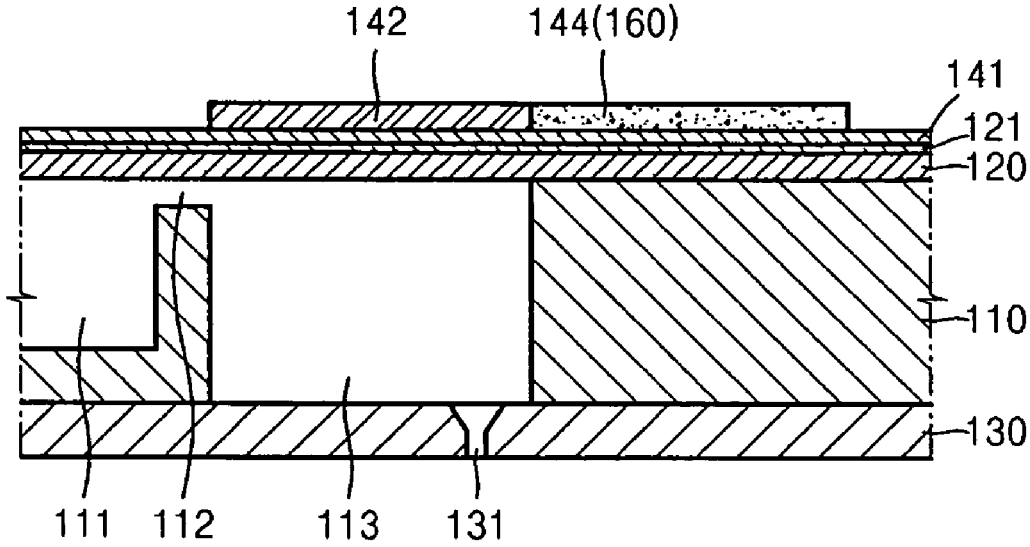

Referring to FIG. 3D, a supporting pad 144 is formed by patterning the photoresist 160 into a predetermined shape. The photoresist 160 may be patterned by well-known photolithography processes that include, for example, exposing and developing. Here, as described above, the supporting pad 144 contacts one end of the piezoelectric layer 142 and extends away therefrom. The supporting pad 144 may have substantially the same height as the piezoelectric layer 142. For this reason, a photoresist having a high viscosity can be used to form the supporting pad 144 to reduce height difference between the piezoelectric layer 142 and the supporting pad 144. Alternatively, the piezoelectric layer 142 and the supporting pad 144 can be leveled to the same height by chemical mechanical polishing (CMP).

Figure 3E:
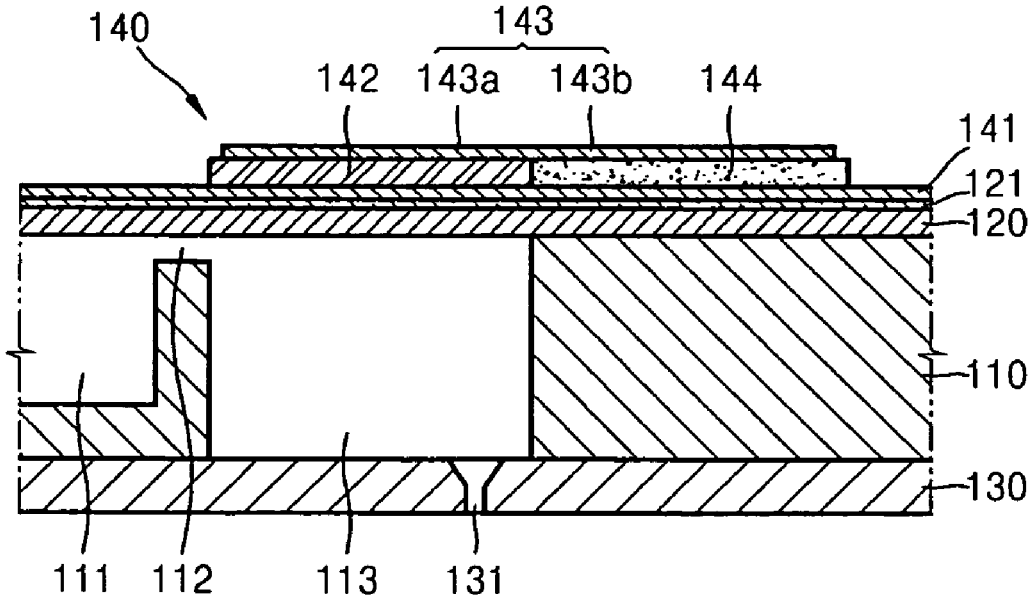

Referring to FIG. 3E, an upper electrode 143 (i.e., a driving electrode) is formed on top surfaces of the piezoelectric layer 142 and the supporting pad 144. Here, the upper electrode 143 has a first portion 143*a* formed on the piezoelectric layer 142 and a second portion 143*b* formed on the supporting pad 144, and the second portion 143*b* may be wider than the first portion 143*a*. The upper electrode 143 may be formed by screen printing an electrode material paste on the top surfaces of the piezoelectric layer 142 and the supporting pad 144, and by drying and sintering the printed paste. Here, since the supporting pad 144 is formed of the photoresist 160 and can be damaged by heat during the sintering of the upper electrode 143, the upper electrode 143 may be formed of an electrode material paste that can be hardened at a low temperature. Alternatively, the upper electrode 143 can be formed on the top surfaces of the piezoelectric layer 142 and the supporting pad 144 by depositing a conductive material to a predetermined thickness by sputtering, an evaporator, or an e-beam using a shadow mask.

Figure 3F:
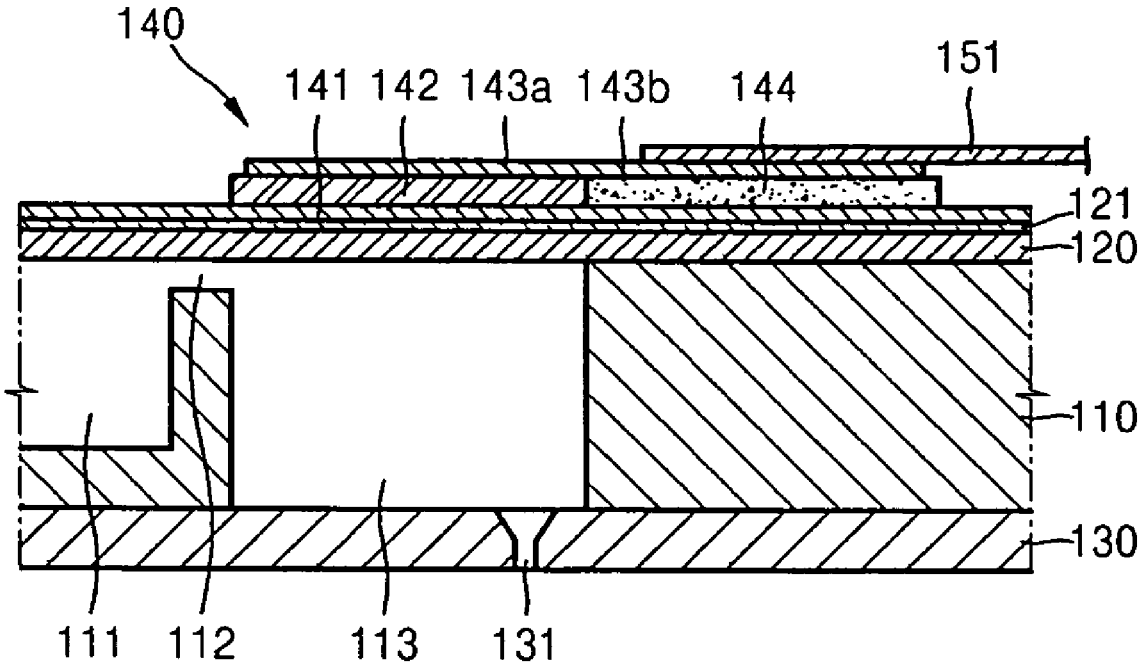

Referring to FIG. 3F, a signal line of a driving circuit, such as a signal line 151 of an FPC 150, is bonded to the second portion 143*b* of the upper electrode 143 formed above the supporting pad 144 to apply a voltage to the upper electrode 143.

Through these operations, a piezoelectric actuator 140 is formed. In the piezoelectric actuator 140, the piezoelectric layer 142 and the supporting pad 144 are formed on the lower electrode 141, the upper electrode 143 is formed on the piezoelectric layer 142 and the supporting pad 144, and the FPC 150 is bonded to the second portion 143*b* of the upper electrode 143 formed on the supporting pad 144.

As described above, according to embodiments of the present general inventive concept, a length of a piezoelectric layer is reduced by forming a supporting pad to extend from an end of the piezoelectric layer and bonding an upper electrode and an FPC above the supporting pad. Therefore, a capacitance, an electric load, and a response time of the piezoelectric layer can be reduced, and durability of the piezoelectric layer can be improved.

Further, since the supporting pad is wide, the upper electrode can also be wide at a portion formed on the supporting pad. Therefore, the FPC can be bonded to the upper electrode more strongly, and bonding failure due to alignment errors can be prevented, so that the FPC can be bonded to the piezoelectric actuator more reliably.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A piezoelectric actuator of an inkjet head, the piezoelectric actuator being formed on a vibration plate to provide a driving force to each of a plurality of pressure chambers, the piezoelectric actuator comprising:

a lower electrode formed on the vibration plate;

a piezoelectric layer formed on the lower electrode at a position corresponding to each of the pressure chambers;

a supporting pad formed on the lower electrode, the supporting pad contacting one end of the piezoelectric layer and extending away from the one end of the piezoelectric layer; and an upper electrode extending from a top surface of the piezoelectric layer to a top surface of the supporting pad, wherein the upper electrode is bonded to a driving circuit above the supporting pad to receive a voltage from the driving circuit.

2. The piezoelectric actuator of claim 1, further comprising:

an insulation layer formed between the vibration plate and the lower electrode.

3. The piezoelectric actuator of claim 1, wherein the piezoelectric layer has substantially the same length as the pressure chamber.

4. The piezoelectric actuator of claim 1, wherein the supporting pad has substantially the same height as the piezoelectric layer.

5. The piezoelectric actuator of claim 1, wherein the supporting pad is formed of an insulating material.

6. The piezoelectric actuator of claim 5, wherein the supporting pad is formed of a photosensitive polymer.

7. The piezoelectric actuator of claim 1, wherein the upper electrode comprises a first portion formed on the piezoelectric layer and a second portion formed on the supporting pad, the second portion being wider than the first portion.

8. The piezoelectric actuator of claim 1, wherein the driving circuit is an FPC (flexible printed circuit) having a signal line bonded to the upper electrode.

9. A piezoelectric actuator of an inkjet head, the piezoelectric actuator comprising:

a vibration plate;

a lower electrode formed on the vibration plate;

a piezoelectric layer formed on the lower electrode;

an upper electrode having a first portion disposed on the piezoelectric layer and a second portion extended from the first portion in a first direction, the first portion having a first width in a second direction perpendicular to the first direction, and the second portion having a second width wider than the first width in the second direction; and a supporting pad disposed between the lower electrode and the second portion of the upper electrode.

10. The piezoelectric actuator of claim 9, wherein the piezoelectric layer is formed on a first area of the lower electrode, and the supporting pad is disposed on a second area of the lower electrode.

11. The piezoelectric actuator of claim 9, wherein the supporting pad is extended from the piezoelectric layer in the first direction.

12. The piezoelectric actuator of claim 9, wherein the supporting pad is wider than the piezoelectric layer in the second direction.

13. The piezoelectric actuator of claim 9, wherein:

the vibration plate comprises a plurality of vibration plates spaced-apart from each other;

the lower electrode formed on the plurality of vibration plates;

the piezoelectric layer comprises a plurality of piezoelectric layers to correspond to the respective vibration plates;

the upper electrode comprises a plurality of upper electrodes to correspond to the respective piezoelectric layers; and the supporting pad comprises a plurality of supporting pads disposed between the lower electrodes and the upper electrodes.

14. The piezoelectric actuator of claim 13, wherein the supporting pads are wider than corresponding ones of the upper electrodes in the second direction.

15. The piezoelectric actuator of claim 13, wherein the supporting pads are formed in a single monolithic body formed on the lower electrodes.

16. The piezoelectric actuator of claim 9, further comprising:

an insulation layer disposed between the vibration plate and the lower electrode, wherein the insulation layer is formed on the vibration plate and the lower electrode is formed on the insulation layer.

17. The piezoelectric actuator of claim 9, further comprising:

a signal line disposed on the second portion of the upper electrode in the first direction to apply a voltage to the upper electrode, wherein a ratio between the second width of the second portion and a third width of the signal line in the second direction is greater than 2:0.

18. The piezoelectric actuator of claim 17, wherein the signal line is not parallel to the second portion of the upper electrode in the second direction.

19. An inkjet head usable in an image forming apparatus, comprising:

an ink flow structure having a flow channel plate and a nozzle plate disposed on a first side of the flow channel plate to form a pressure chamber; and a piezoelectric actuator having a vibration plate disposed on a second side of the flow channel plate, a lower electrode formed on the vibration plate, a piezoelectric layer formed on the lower electrode at a position corresponding to the pressure chamber, a supporting pad formed on the lower electrode and contacting one end of the piezoelectric layer to be extended away from the one end of the piezoelectric layer, and an upper electrode extending from a top surface of the piezoelectric layer to a top surface of the supporting pad, wherein the upper electrode is bonded to a driving circuit above the supporting pad to receive a voltage from the driving circuit.

20. An inkjet head usable in an image forming apparatus, comprising:

an ink flow structure having a flow channel plate and a nozzle plate disposed on a first side of the flow channel plate to form a pressure chamber; and a piezoelectric actuator having a vibration plate disposed on a second side of the flow channel plate, a lower electrode formed on the vibration plate, a piezoelectric layer formed on the lower electrode, and an upper electrode having a first portion disposed on the piezoelectric layer and a second portion extended from the first portion in a first direction to be connected to a signal line, the first portion having a first width in a second direction perpendicular to the first direction, and the second portion having a second width wider than the first width in the second direction; and a supporting pad disposed between the lower electrode and the second portion of the upper electrode.

* * * * *